US007794298B2

(12) United States Patent
Murakami

(10) Patent No.: US 7,794,298 B2
(45) Date of Patent: Sep. 14, 2010

(54) ELECTRON-EMITTING DEVICE AND METHOD OF PRODUCING THEREOF

(75) Inventor: Shunsuke Murakami, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 347 days.

(21) Appl. No.: 11/672,678

(22) Filed: Feb. 8, 2007

(65) Prior Publication Data

US 2007/0188068 A1 Aug. 16, 2007

(30) Foreign Application Priority Data

Feb. 10, 2006 (JP) ..... 2006-034032

(51) Int. Cl.
*H01J 9/24* (2006.01)

(52) U.S. Cl. ..... 445/24; 445/51; 313/497

(58) Field of Classification Search ..... 445/46, 445/57, 23–25, 47–51; 313/310, 495–497
See application file for complete search history.

(56) References Cited

U.S. PATENT DOCUMENTS

| | | | | |
|---|---|---|---|---|
| 5,473,218 | A | 12/1995 | Moyer | 313/309 |
| 7,109,663 | B2 | 9/2006 | Fujiwara et al. | 315/169.4 |
| 7,259,520 | B2 | 8/2007 | Fujiwara et al. | 315/169.1 |
| 2004/0036401 | A1 | 2/2004 | Konuma et al. | 313/311 |
| 2004/0251812 | A1 | 12/2004 | Fujiwara et al. | 313/495 |
| 2004/0253898 | A1 * | 12/2004 | Teramoto | 445/50 |
| 2005/0087726 | A1 * | 4/2005 | Anazawa et al. | 252/500 |
| 2006/0061289 | A1 | 3/2006 | Fujiwara et al. | 315/169.1 |
| 2006/0066199 | A1 | 3/2006 | Ichikawa et al. | 313/311 |
| 2007/0257593 | A1 | 11/2007 | Murakami | 313/311 |
| 2008/0287030 | A1 * | 11/2008 | Kim et al. | 445/46 |

FOREIGN PATENT DOCUMENTS

| | | |
|---|---|---|
| JP | 8-55564 | 2/1996 |
| JP | 10-55753 | 2/1998 |
| JP | 10-64416 | 3/1998 |
| JP | 2002-140979 | 5/2002 |

(Continued)

OTHER PUBLICATIONS

Machine Translated Takao et al. (JP 2004-335285).*

(Continued)

*Primary Examiner*—Joseph J Williams
*Assistant Examiner*—Andrew J Coughlin
(74) *Attorney, Agent, or Firm*—Fitzpatrick, Cella, Harper & Scinto

(57) ABSTRACT

An object of the invention is to prove a method of producing an electron-emitting device, in which metal content in an electron emission film can be relatively easily controlled and adhesiveness between electrodes and the like in contact with the electron emission film and the electron emission film is good. The method is a method of producing an electron-emitting device including a cathode electrode and a metal-containing electron emission film located above the cathode electrode. The method includes a first step (A) of preparing an electroconductive first layer for the cathode, a second layer for the electron emission film located above the first layer, and a third layer for a metal-containing electron beam focusing electrode in contact with the second layer and a second step (B) of diffusing the metal from the third layer into the second layer.

8 Claims, 10 Drawing Sheets

FOREIGN PATENT DOCUMENTS

| | | |
|---|---|---|
| JP | 2004-71536 | 3/2004 |
| JP | 2004-107162 | 4/2004 |
| JP | 2005-26209 | 1/2005 |
| WO | WO 03/107377 A1 | 12/2003 |

OTHER PUBLICATIONS

K. B. K. Teo et al., "Field Emission from Dense, Sparse, and Patterned Arrays of Carbon Nanofibers." Applied Physics Letters, vol. 80, No. 11, pp. 2011-2013, Mar. 18, 2002.

* cited by examiner

ELECTRON-EMITTING DEVICE AND METHOD OF PRODUCING THEREOF

BACKGROUND OF THE INVENTION

1. Field of the Invention

The present invention relates to an electron-emitting device, an electron source, and a method of producing an image display device.

2. Description of the Related Art

The electron-emitting device includes an electron-emitting device of a field emission type (hereinafter, referred to as "FE type") and an electron-emitting device of a surface-conduction type disclosed in Japanese Patent Application Laid-Open No. H10-055753.

The FE type includes an electron-emitting device using a carbon fiber disclosed in K. B. K. Teo and eight others, Field Emission from Dense, Sparse and Patterned Arrays of Carbon Nanofibers, "Applied Physics Letters", Mar. 18, 2002, Vol. 80, P. 2011 to 2013, Japanese Patent Application Laid-Open No. 2002-140979, and Japanese Patent Application Laid-Open No. 2004-107162, and an electron-emitting device having an electron emission film with a flat surface disclosed in Japanese Patent Application Laid-Open No. 2004-071536, Japanese Patent Application Laid-Open No. H08-055564, and Japanese Patent Application Laid-Open No. 2005-026209.

As an example of the electron-emitting device having few spread of the electron beam to be emitted, there are an electron-emitting device provided with an aperture (so-called "gate hole") on a flat electron emission film and having a laminate with an insulating layer and a gate electrode. In the electron-emitting device having such a flat electron emission film, since a relatively flat equipotential surface is formed on an electron emission film surface, the spread of the electron beam can be made small. Further, Japanese Patent Application Laid-Open No. H08-055564 and Japanese Patent Application Laid-Open No. 2002-140979 propose an electron-emitting device which disposes a conductive layer on the electron emission film to make the spread of the emitted electron beam small. Japanese Patent Application Laid-Open No. 2004-071536 and Japanese Patent Application Laid-Open No. 2005-026209 propose an electron-emission film containing metal excellent in electron emission characteristic and an electron-emitting device using the electron emission film provided with a dipole layer on the surface.

Further, Japanese Patent Application Laid-Open No. H10-064416 discloses a process in which an alkali metal intended to be an acceptor is provided on the surface of a semiconductor to make the surface vicinity of the semiconductor into a strong p-type, and then, the alkali metal is diffused into the semiconductor. Specifically, Na2Se or K2S is thinly vapor-deposited on the semiconductor surface of ZnS, Na2Se or K2Se on the semiconductor surface of ZnSe, and Na2Te or K2Te on the semiconductor surface of ZnTe or CdTe. Japanese Patent Application Laid-Open No. H10-064416 discloses that the alkali metal is heated at 500 to 600° C. in an inactive gas so that alkali metal is diffused into the semiconductor.

A method of forming the electron emission film containing metal excellent in electron emission characteristic as disclosed in Japanese Patent Application Laid-Open No. 2004-071536 includes various methods such as a method of sputtering metal and graphite simultaneously, a method of sputtering a mixed target of metal and graphite, and a method of ion-implanting metal into a carbon thin film. However, these methods are complicated in a producing step. Further, to stabilize the electron emission characteristic of the electron emission film, it is important to control a metal amount in the electron emission film. Further, when adhesiveness between the electron emission film and a layer (for example, a cathode electrode) in contact with the electron emission film is bad, due to heat and the like generated in various steps of the production time and during driving, the electron emission film may be peeled off in an extreme case, thereby causing various problems.

Hence, an object of the present invention is to provide a method of producing an electron-emitting device, which can be easily fabricated and can relatively easily control an amount of metal in the electron emission film, and in which the adhesiveness between the electrode and the like in contact with the electron emission film and the electron emission film is good. Another object of the invention is to provide a method of producing an electron-emitting device in which electron emission characteristic is stabilized and spread of electron beam is small. Further, another object of the invention is to provide a method of producing an electron source having a great number of electron-emitting devices and a method of producing an image display device using the electron source.

SUMMARY OF THE INVENTION

A configuration of the present invention set up in order to achieve the above described objects is as follows.

According to a first aspect of the present invention, a method of producing an electron-emitting device which includes a cathode, an electron emission film comprising a carbon layer including metal, which disposed on the cathode and provided with an electron emission region therein, and an electrode disposed on a predetermined region on the electron emission film, comprises the steps of A) preparing a structure of an electroconductive layer of forming the cathode, a carbon layer on the electroconductive layer and a metal layer or a metal-containing layer in contact with the carbon layer; and B) diffusing metal contained in the metal layer or metal-containing layer into the carbon layer. The embodiment further comprises a step (C) of removing part of the metal layer or metal-containing layer after the processing of the step (B) to expose at least part of the carbon layer, wherein part of the metal layer or metal-containing layer remained after the removal processing step (C) constitutes the electrode, and the electrode is an electron beam focusing electrode.

In the embodiment of the above first aspect, the electron-emitting device further includes a gate, the structure in the step (A) further includes an insulating layer on the metal layer or metal-containing layer and a conductive layer of forming the gate electrode on the insulating layer, and the method further comprises a step (D) of opening an aperture through the metal layer or metal-containing layer the insulating layer and the gate electrode-conductive layer after the processing of said step (B) to expose at last part of the carbon layer. The metal layer or metal-containing layer surrounding the aperture constitutes the electron beam focusing electrode. The metal-diffusion is performed by heating the carbon layer so that the diffused metal is grained in the electron emission film.

According to a second aspect of the invention, a method of producing an electron-emitting device which includes a cathode, an electron emission film disposed on the cathode and provided with an electron emission region therein, and an electron beam focusing electrode disposed on a predetermined region of the electron emission film, comprises the steps of A) preparing a structure of an electroconductive layer of forming the cathode, a precursor layer of the electron emission film on the electroconductive layer and a metal layer or a metal-containing layer in contact with the precursor layer; and B) diffusing metal contained in the metal layer or metal-containing layer into the precursor layer, and C) removing part of the metal layer or metal-containing layer after the processing of said step (B) to expose at least part of the precursor layer, wherein part of metal layer or metal-containing layer remained after the removal processing step (C) constitutes the electron beam focusing electrode. In the embodiment, the precursor layer is heated so that the diffused metal is grained in the electron emission film.

According to a third aspect of the present invention, a method of producing an electron-emitting device which includes a cathode, an electron emission film disposed on the cathode and provided with an electron emission region therein, and an electron beam focusing electrode disposed on a predetermined region of the electron emission film, comprises the steps of A) preparing a structure of an electroconductive layer (10) of forming the cathode, a precursor layer (11) of the electron emission film on the electroconductive layer and a metal layer or a metal-containing layer (12) in contact with the precursor layer; and B) granulating metal diffused from the metal layer or metal-consisting layer into the precursor layer.

The metal layer or the metal-containing layer in the above methods consists essentially of metal or metals selected from a group of Fe, Co, Ni, Pd and Pt or alloy of metal or metal selected from the group. An image forming device comprising the emitting-emitting device produced according to the above methods and a light-emitting screen irradiated by electrons from the electron-emitting device is fabricated.

An electron-emitting device according to a forth aspect of the present invention comprises a cathode, an electron emission film disposed on the cathode and provided with an electron emission region therein, and metal layer or metal containing layer in contact with the electron emission film, wherein the electron emission film includes metal diffused from the metal layer or metal containing layer.

An electron-emitting device according to fifth aspect of the present invention comprises a cathode, an electron emission film disposed on the cathode and provided with an electron emission region therein, and, an electron beam focusing electrode in contact with the electron emission film, wherein the electron emission film comprises a matrix material and metal dispersed in the matrix material, the metal being the same material as that of the electron beam focusing electrode or the same metal material as that contained in the electron beam focusing electrode. In the embodiment, the matrix material of the electron emission film is carbon and the electron beam focusing electrode consists essentially of metal or metals selected from a group of Fe, Co, Pd and Pt or alloy of metal or metal selected from the group.

In the present specification, "metal-containing layer" means a layer which comprises metal and material other than the metal. And, hereinafter, "metal layer and metal-containing layer" will be comprehensively referred to as —metal-containing layer—.

According to the present invention, metal-containing amount in the electron emission film can be easily controlled, and electron-emission characteristic is stabilized, and moreover, a structure for convergence (focusing) of beam is formed, and adhesiveness between an electron emission film and an electrode can be improved, and electron emission characteristic can be maintained for a long period of time.

Further features of the present invention will become apparent from the following description of exemplary embodiments with reference to the attached drawings.

DESCRIPTION OF THE EMBODIMENTS

An embodiment of the present invention will be illustratively described in detail with reference to the drawings. However, the scope of the present invention is not limited to the size, material, shape, and other relative positions or the like of the component parts described in the following embodiment, unless specifically described otherwise.

Figure 1A:
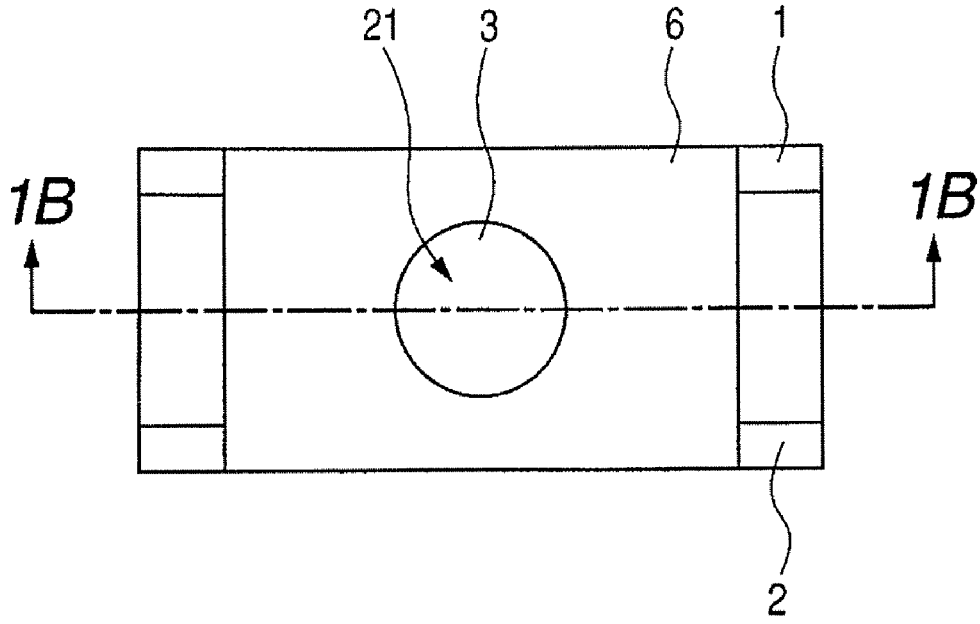
FIGS. 1A and 1B are schematic illustrations showing one example of a method of producing an electron-emitting device according to the present invention.
Figure 1B:
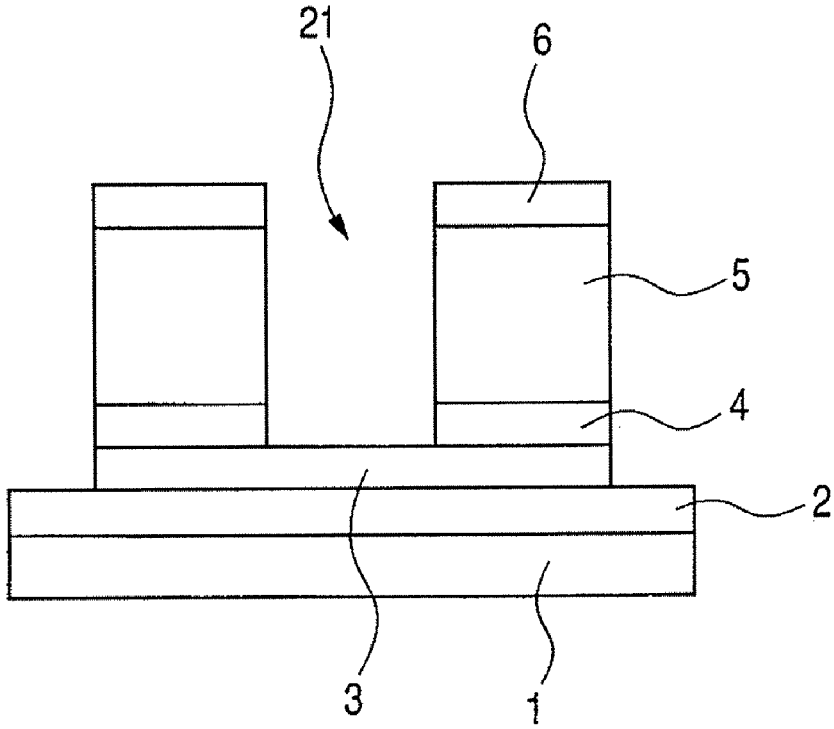

FIGS. 1A and 1B are schematic illustrations showing one example of an electron-emitting device produced by a producing method of the present invention. FIG. 1A is a top plan schematic illustration, and FIG. 1B is a sectional schematic illustration cut along the line 1B-1B of FIG. 1A. Reference numeral 1 denotes a substrate, Reference numeral 2 a first electrode (typically equivalent to a cathode electrode), reference numeral 3 an electron emission film, reference numeral 4 a second electrode (typically equivalent to a convergence electrode), reference numeral 5 a layer including an insulating material (insulating layer), and reference numeral 6 a third electrode (typically equivalent to a gate electrode). Further, reference numeral 21 denotes an aperture (pass-through aperture) which communicates with the second electrode and the insulating layer 5 and the third electrode 6.

The electron emission film 3 is preferably in a form of containing a metal in the film composed mainly of carbon particularly in view of electron emitting characteristic. Further, the film thickness of the electron emission film 3 is preferably within the range of not less than 5 nm and not more than 10 μm, and particularly not less than 10 nm and not more than 1 μm as a practical range.

Figure 8:
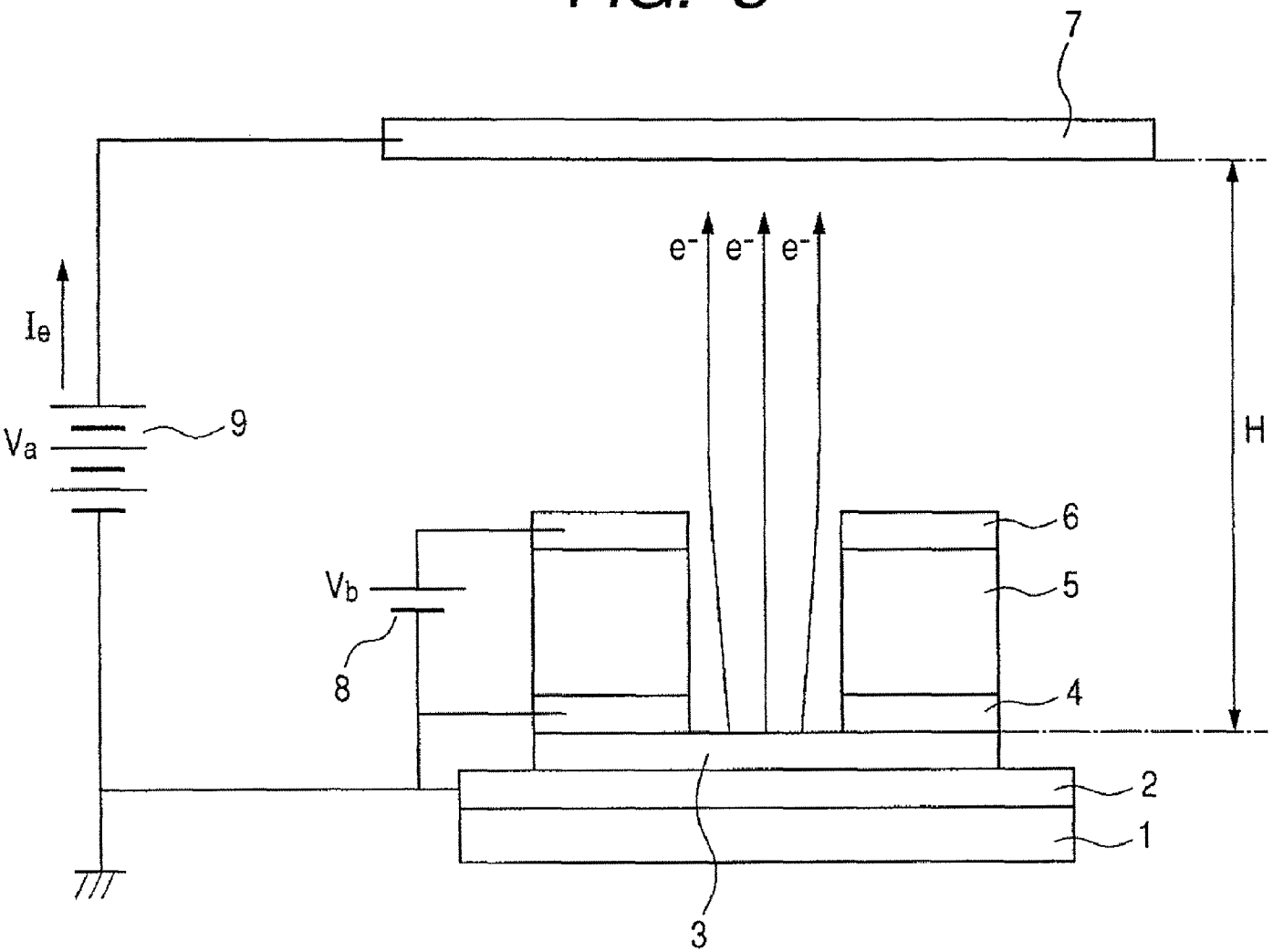
FIG. 8 is a schematic illustration when the electron-emitting device of the present invention is driven.

FIG. 8 is a schematic illustration showing a state when an electron is emitted from the electron-emitting device illustrated in FIGS. 1A and 1B. In FIGS. 1A, 1B and 8 the same reference numerals are attached to the same component parts. Reference numeral 7 denotes a fourth electrode (typically an anode electrode), reference numeral 8 a driving power source, and reference numeral 9 a high voltage power source. When the electron is emitted, a first electrode 2 and a second electrode 4 are made into the same potential or into the substantially same potential. To enhance convergence, the potential of the second electrode 4 is made lower than the potential of the first electrode 2. Then, the potential higher than the first electrode 2 is supplied to the third electrode 6, and the electron from the flat electron emission film 3 is emitted to an electric field. The electron emitted from the electron emission film 3 is pulled into the fourth electrode (anode electrode) set to a sufficiently higher potential (typically a potential higher than ten times) than the third electrode 6. The fourth electrode 7 is applied with a voltage practically not less than 1 kV and not more than 30 kV from the high voltage power source 9, and between the first electrode 2 and the third electrode 6, a voltage typically not less than 0V and not more than 100V is applied. The potential of the first electrode 2 is preferably set to the ground potential circuit-design wise.

In FIGS. 1A and 1B, the first electrode 2 and the second electrode 4 are connected so as to be made into the substantially same potential. Further, Vb indicates a voltage (voltage output from the power source 8) applied between the third electrode 6 and the first electrode 2, Va indicates a voltage (voltage output from the power source 9) applied to the anode electrode 8, and Ie indicates an electron-emitting current.

When Vb and Va are applied, a strong electric field is formed inside an aperture 21. Depending on Vb and the thickness and shape of the insulating layer 5, a dielectric constant of the insulating layer, and the like, a shape of equipotential surface inside the aperture 21 is defined. Outside of the aperture 21, though depending mainly on a distance H to the anode electrode 7, Va approximately forms a parallel equipotential surface. When an electric field strength applied to the surface of the electron emission film 3 located inside the aperture 21 exceeds a threshold value (minimum electric field strength) of the electric field strength sufficiently enough to start an electron emission from the electron emission film, an electron is emitted from the electron emission film 3. The electron emitted from the aperture 21 collides against the anode electrode 7. The aperture 21 has preferably a cylindrical shape, but does not exclude a polygonal shape.

Figure 10:
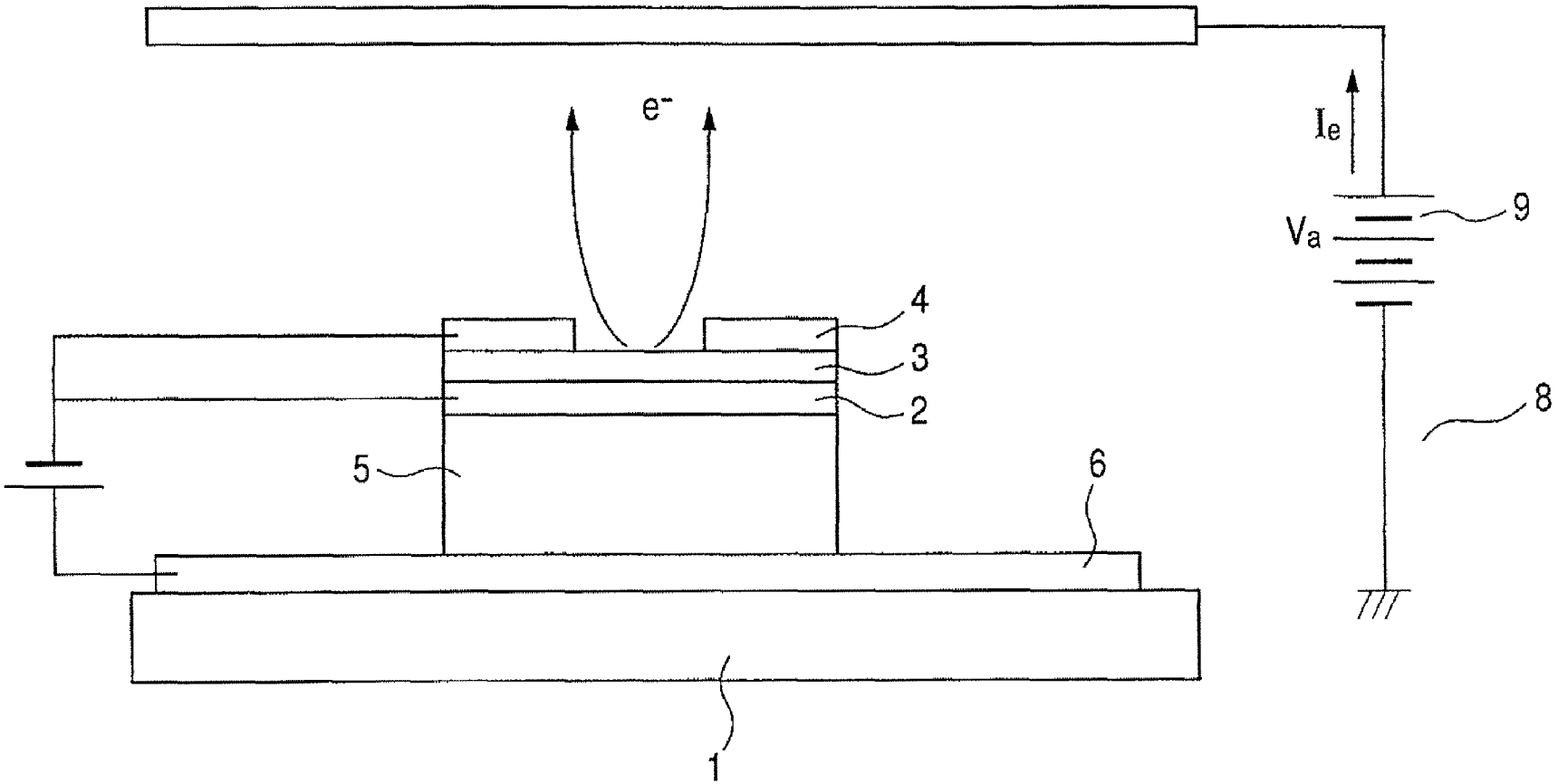
FIG. 10 is a schematic illustration showing an example of another configuration of the electron-emitting device of the present invention.

Further, the method of producing the electron-emitting device of the present invention to be described later in detail illustrates another embodiment of a preferably applicable electron-emitting device in FIG. 10. In FIGS. 1A, 1B and 10, the same reference numerals are attached to the same component parts. That is, the configuration of FIG. 10 is a configuration in which the third electrode 6 is disposed between the substrate 1 and the first electrode 2, and between the first electrode 2 and the third electrode 6, the insulating layer 5 is disposed. The present invention can be preferably applied to the electron-emitting device of this configuration. Even when the electron is emitted from the electron-emitting device of this configuration, as described by using FIG. 8, by providing the potential higher than the first electrode 2 to the third electrode 6, the electron can be emitted to the electric field from the flat electron emission film 3.

Taking the electron-emitting device of the structure illustrated in FIGS. 1A and 1B for example, an example of the method of producing the electron-emitting device of the present invention will be described below by using the schematic section illustrated in FIGS. 2A, 2B, 2C and 2D.

Step A

Step a-1

A substrate 1 provided with a conductive first layer 10 on the surface, which finally becomes the first electrode 2, is prepared.

The substrate 1 can utilize quartz glass, glass with impurity content such as Na diminished, blue sheet glass, laminate laminated with silicon oxide (typically, $SiO_2$) on a silicon substrate by sputtering method and the like, ceramic insulating substrate such as alumina.

The first layer 10 includes a material having conductivity, and can be formed by the general vacuum deposition technique for film such as an vapor-deposit method and sputtering method and photolithography technique. Specifically, the material of the first layer 10 can utilize metal or nitride of metal and carbide of metal. However, a chemically stabilized material hard to diffuse into the electron emission film 3 is desirable. Hence, a material low in diffusibility (diffusion probability) toward the electron emission film 3 (second layer 11) is preferably selected rather than the metal (metal diffused into the second layer 11) of a third layer 12 to be described later. Further, desirable is a material in which the metal diffused into the second layer 11 from the third layer 12 at the step to be described later is hard to diffuse into the first layer 10.

Hence, as the material of the first layer 10, Ti, Nb, Mo, Ta, and W are more specifically desirable. However, these materials can be suitably selected by a combination of the metal (metal diffused into the second layer 11) of the third layer 12 to be described at a later step. Further, the thickness thereof is set in the range of not less than 10 nm and not more than 100 μm as a practical range, and is preferably selected in the range of not less than 100 nm and not more than 10 μm.

Here, though an example has been illustrated in which the substrate 1 and the first layer 12 include separate members, these components may include one conductive member.

Step a-2

On the first layer 10, the second layer 11, which finally becomes the electron emission film 3, is provided. The second layer 11 can be formed by a vapor-deposit method, sputtering method, printing method, and the like. The second layer 11 is a matrix (host) material (such as carbon) layer in which metal is diffused at a later process of the electron emission film. The second layer is a precursor layer.

The first electrode 2 is equivalent to a so-called a cathode electrode, but depending on the configuration of the electron-emitting device, the first electrode 2 may have the functions of a resistor for current control so that an excessive emission current does not arise. That is, in such a case, the first electrode 2 may be a resistive layer.

Figure 9B:
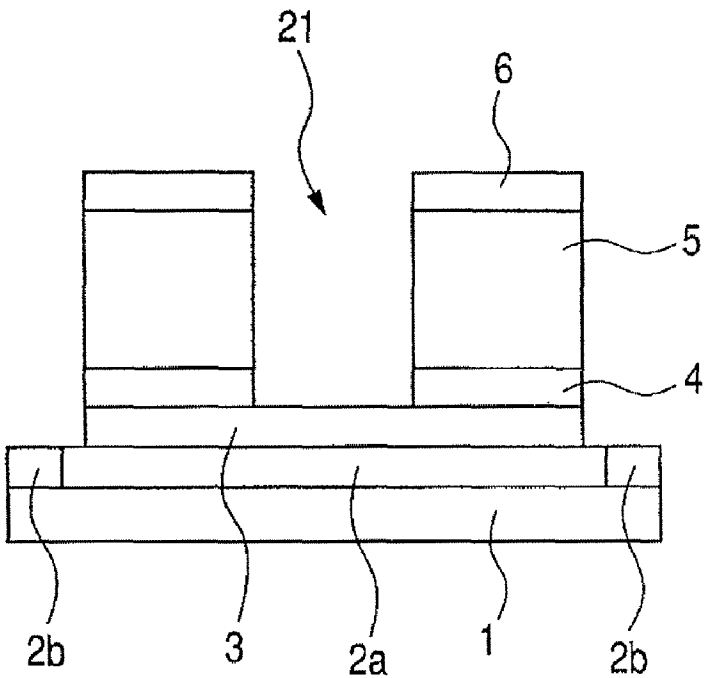
FIGS. 9A and 9B are schematic illustrations showing an example of another configuration of the electron-emitting device of the present invention.
Figure 9A:
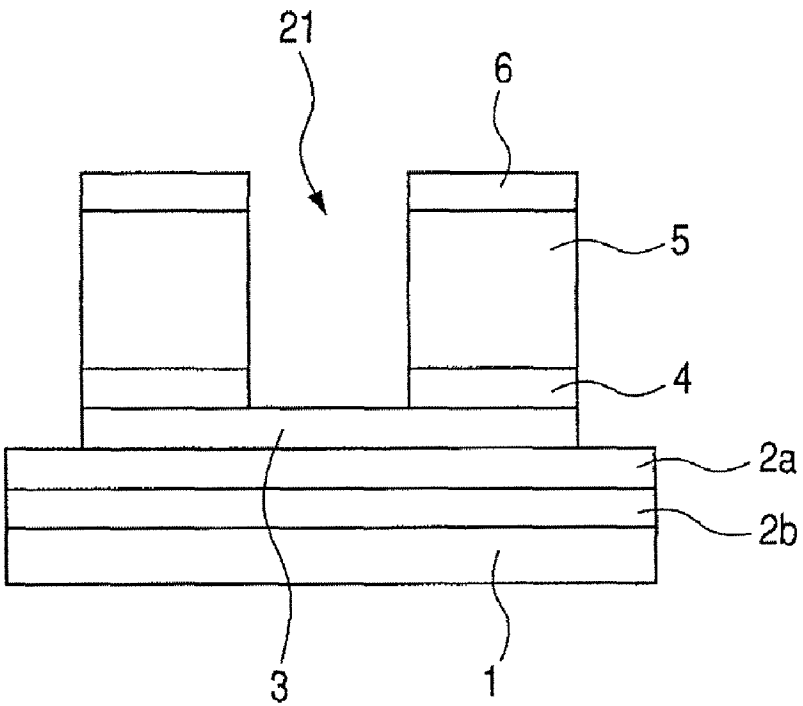

Alternatively, further, as shown in FIG. 9A, the first electrode (cathode electrode) 2 may include a laminate with a resistive layer 2*a* higher in resistance than an electrode 2*b* low in resistance and the electrode 2*b*. Alternatively, as shown in FIG. 9B, immediately below the electron emission layer 3, the resistive layer 2*a* is located, and at its side, the electrode 2*b* may be located. When the electrode 2*b* and the resistive layer 2*a* are provided in this manner, the drive power source 8 is connected to the third electrode 6 and the electrode 2*b*. Then, from the electrode 2*b*, an electron is supplied to the electron emission film 3 through the resistive layer 2*a*.

The matrix (host) material of the second layer 11 is selected from a semiconductor or insulating material. Particularly, with a view to control the electric resistance and electric emission characteristic of the electron emission film, the material having electric resistivity larger than the electric resistivity of metal to be contained is desirable. The insulating material is more desirable, and particularly, the material composed mainly of carbon is desirable. Further, the material in which metal such as Fe, Co, Ni, Pd, and Pt is easily diffused is desirable. For example, from a diamond like carbon, amorphous carbon, and an organic matter such as photosensitive resin, the material can be suitably selected.

Step a-3

On the second layer 11, the third layer 12, which finally becomes the second electrode 4 and contains metal, is provided. The third layer 12 can be formed by the vapor-deposit method, sputtering method, printing method, and the like. The material of the third layer 12 is preferably easy to diffuse metal inside the third layer 12 into the second layer 11. For example, if contained in the electron emission film 3, it is a good material which can allow the electron emission film to manifest good electron emission characteristic. Metal such as Fe, Co, Ni, Pd, and Pt or alloy metal containing these metals can be used for the third layer 12. Although the material of the third layer 12 can be suitably selected according to the combination of the material of the second layer 11, when the second layer 11 is composed mainly of carbon, the third layer 12 preferably contains the metal selected from the above described group consisting of Fe, Co, Ni, Pd, and Pt. Particularly, the preferable metal is Co or Pd.

The third layer 12 is for controlling the variation of electric field strength applied on the surface of the electron emission layer 3 finally at the driving time. Hence, its thickness is practically set to the range of not less than 1 nm and not more than 10 μm, and is preferably selected in the range not less than 10 nm and not more than 1 μm.

At step a-3, the third layer 12 which diffuses metal into the second layer 11 may be provided close to the second layer 11. Hence, the third layer 12 may be disposed below the second layer 11.

In that case, step a-3 can be replaced by the step of providing the third layer 11 between the conductive first layer 10 and the second layer 11. Alternatively, by allowing the first layer 10 to contain metal to be diffused, the function of the third layer to supply (diffuse) metal can be given to the first layer 10. In all these cases, preferably on the second layer 11, a conductive layer which becomes the second electrode 4 for controlling distribution of the electric field strength applied on the surface of the electron emission film 3 at the driving time is separately provided at the position of the member shown by reference numeral 12 illustrated in FIG. 2A.

A layer which finally becomes the second electrode 4 includes the material having the conductivity, and can be formed by the general vacuum deposition technique for film for film such as a vapor-deposit method, sputtering method, and photolithography technology.

The material of the conductive layer which finally becomes the second electrode 4 is preferably a chemically stabilized material in which the material of the conductive layer which becomes the second electrode 4 is harder to diffuse into the second layer 11 than the material included in the third layer. Such a material can utilize metal smaller in diffusion coefficient than the material (metal diffused into the second layer 11) included in the third layer or alloy metal containing nitride and carbide of these metals. More specifically, the material such as TiN, TiA, and IN can be utilized.

Further, the thickness of the second electrode 4 is set to the range of not less than 1 nm and not more than 10 μm, and is preferably selected within the range of not less than 10 nm and not more than 1 μm. Since a metal-containing layer 12 is in a state of being always disposed below the electron emission film 3, the metal-containing amount in the electron emission film 3 is stabilized much more than when the metal-containing layer 12 is disposed on a main ingredient layer 11, and moreover, adhesiveness between the electron emission film 3 and the cathode electrode 10 is improved.

Further, the third layer 12 which diffuses metal into the second layer 11 may be provided separately on and under the second layer 11 so as to sandwich the second layer 11. When the electron-emitting device is formed in this manner, adhesiveness between the electron emission film 3 and its on and under layers is improved much more. However, an attention must be given to a heating step so that metal-containing amount in the electron emission film 3 does not become too large.

When the third layer 12 is provided on and under the second layer 11, the first layer 10 and/or third layer 12 is allowed to include the same metal as metal included in the third layer 12, so that it can be also used for a layer for diffusing the metal into the second layer 11. Alternatively, on and under the second layer 11, apart from the first layer 10 and the third layer 12, a layer for allowing metal to be diffused into the second layer may be provided. That is, between the first layer 10 and the second layer 11 and/or between the third layer 12 and the second layer 11, a layer equivalent to the layer (third layer) containing the above described metal may be provided.

Step a-4

On the third layer 12, a fourth layer 13 including an insulating material which finally becomes the insulating layer 5 of FIGS. 2A, 2B, 2C and 2D is provided. The fourth layer 13 can be formed by the publicly known deposition method such as the sputtering method, CVD method, vacuum-vapor-deposit method, and printing method. The thickness of the fourth layer 13 is set to the range of not less than 1 nm and not more than 100 μm as a practical range, and is preferably selected from the range of not less than 10 nm and not more than 10 μm. As a desirable material, a material endurable to high electric field such as SiO2, SiN, A12O3, CaF, and undoped diamond and yet high in withstand pressure is desirable.

Step a-5

On the fourth layer 13 including the insulating material, a conductive fifth layer 14 which finally becomes the third electrode 6 is disposed. The fifth layer 14 can be formed by the same technique as the forming method of the first layer 10. The material of the fifth layer 14 can be suitably selected from a material group applicable to the first conductive layer 10. In practice, the thickness of the fifth layer 14 is set to the range of not less than 1 nm and not more than 100 μm, and is preferably selected in the range of not less than 10 nm and not more than 10 μm.

Figure 2A:
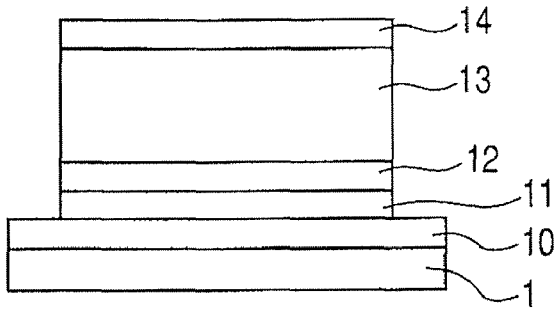
FIGS. 2A, 2B, 2C and 2D are cross sections illustrating a configuration of the electron-emitting device according to the present invention.

By the above described steps, the structure shown in FIG. 2A can be provided.

Step B

A first aperture 20 penetrating through the fifth layer 14 and the fourth layer 13 formed in step A described above is provided.

Specifically, on the fifth layer 14, a mask (not illustrated) having a pattern (aperture) for forming the aperture 20 is formed. By using this mask, an etching step is performed in which the first aperture 20 penetrating through the fifth layer 14 and the fourth layer 13 and reaching up to the third layer 12 is formed. The etching method can adapt various publicly known techniques.

Further, the flat surface shape (sectional shape in parallel with the surface of the substrate 1) of the first aperture 20 is not limited to a circular shape, and may be quadrangle and polygonal such as a square shape and rectangle shape. After forming the first aperture 20, the mask pattern is removed.

Step B can be performed after performing following step C subsequent to step A described above. In that case, step A is replaced by an etching step forming the aperture 21 (exposing part of the electron emission film 3) penetrating through the fifth layer 14, the fourth layer 13, and the third layer 12 and reaching up to the upper surface of the electron emission film 3. That is, in that case, step B is not performed, and step D to be described later only may be performed.

Step C

After finishing at least the above described step a-3, the metal contained in the third layer 12 is diffused into the second layer 11, so that the second layer 11 is squeezed to the electron emission film 3. As a method for diffusing, heating is preferably used. Heating may be applied at least to the second layer 11 and the third layer, but to perform heating more simply, the entire substrate 1 may be heated. As the heating method, the substrate 1 is disposed in a calcining furnace and the like, and the entire substrate 1 may be heated by a heater or lamp or a method of heating at least the second layer 11 and the third layer by laser and the like may be used, and the heating method is not particularly limited to any method. Further, the atmosphere at the heating time may be either of vacuum or gas, but oxidation of the conductive layer is not desirable. When heating the substrate 1 in gas, heating in an inactive gas is desirable. Further, a degree of vacuum when the heating is performed in vacuum is preferably not more than $10^{-4}$ Pa.

Heating temperature is selected between not less than 400° C. and not more than 1,000° C. Heating temperature, holding time in the heating temperature, temperature rising rate up to the heating temperature, temperature falling rate for cooling after heating are suitably selected. A combination of the metal material contained in the third layer 12 and the material of the second layer 11 and a heating step performed at a tail end process to be described later are given consideration. A diffusing degree of metal into the second layer 11 is selected so as to become a desired diffusing degree. The heating temperature, in the step subsequent to step C described above, is preferably controlled to the temperature lower than the heating temperature in step C described above.

The electron emission film 3 preferably has a configuration containing metal in the film composed mainly of carbon particularly in view of the electron emission characteristic. Consequently, the above described second layer 11 preferably includes a layer composed mainly of carbon. By heating in step C, metal is diffused by the second layer 11 (before heating) and the electron emission film 3 (after heating), and therefore, the compositions thereof change. Further, the main component of the second layer 11 may partially degenerate in crystallinity before heating and after heating. Further, if the film thickness of the second layer 11 is set up in the range of not less than 1 nm and not more than 100 μm and particularly in the range of not less than 1 nm and not more than 100 nm, stabilized and excellent electron emission characteristic is readily obtained, and this is desirable.

Further, step C described above may be performed at any time after the third layer 13 is provided in contact with the second layer 11, and may be not necessarily performed subsequent to step B described above. However, step C must be performed before the aperture for penetrating through the third layer 12 is provided.

Step D

An aperture 21 penetrating through the fifth layer 14, the fourth layer 13, and the third layer 12 and reaching up to the upper surface of the electron emission film 3 (the electron emission film 3 is exposed) is provided.

When step B has already been performed, the second aperture 21 communicating with the first aperture 20 provided at step B and penetrating through the third layer 12 and reaching up to the upper surface of the electron emission film 3 may be provided.

As a forming method of the aperture 21, various etching techniques can be adopted. When the aperture 21 is formed by etching by using the fifth layer 14 as a mask through an aperture provided on part of the fifth layer 14, the film thickness of the fifth layer rather than the third layer 12 is required to be set thick. Further, a material slower in etching rate than the third layer 12 is used for the fifth layer 14 so that the material may be used as a mask for forming the aperture 21. The technique for forming the aperture 21 is not particularly limited.

By step D (and step B) described above, the fifth layer 14 becomes the third electrode 6 (typically equivalent to the gate electrode) illustrated in FIGS. 1A and 1B. The fourth layer 13 becomes the layer (insulating layer) 5 illustrated in FIGS. 1A and 1B. The third layer 12 becomes the second electrode 4 (typically equivalent to a convergence electrode) illustrated in FIGS. 1A and 1B.

While the electron emission film can be formed by the above described steps, the present invention, after forming the aperture 21, can further include at least one step from among two steps (steps E and F) described below, and most preferably, both of the steps described below. The addition of these steps further improves the electron emission characteristic. When both of steps E and F are performed, they may be performed simultaneously or separately. When performing separately, step F may be preferably performed after performing step E.

Step E

Figure 3:
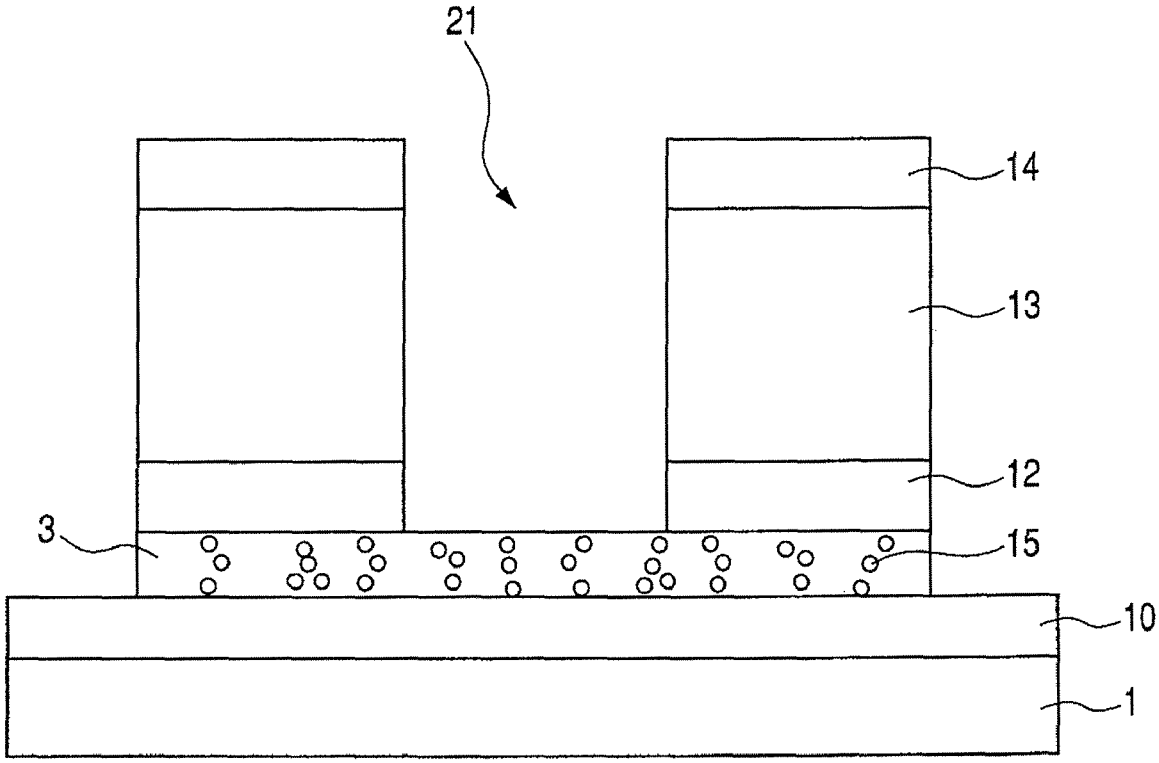
FIG. 3 is a schematic illustration showing part of the method of producing the electron-emitting device according to the present invention.

The electron emission film 3 (second layer 11 after metal is diffused) is heated, and the diffused metal is grained, and as illustrated in FIG. 3, a plurality of particles (grains) 15 containing metals, respectively is provided in the electron emission film 3. The heating temperature is selected from the range of 400° C. to 1000° C. The heating method can adopt various techniques. For example, a technique can be employed in which energy such as light is irradiated at part of the electron emission film 3 (second layer 11 after metal is diffused) exposed inside the aperture 21 with the aperture 21 as a mask, so that only the exposed part of the electron emission film 3 substantially inside the aperture 21 can be heated. Alternatively, a method of heating inside a heating furnace including the substrate 1 can be also adopted. The heating temperature and temperature rising rate up to the heating temperature, holding time in the heating temperature, and temperature falling rate for cooling after heating are suitably decided according to a combination of the type of metal of third layer 12 and the type of the second layer 11.

The electron emission film 3 after having passed through step E has a configuration in which metal fine particles (grains) are contained in a carbon thin film, and the film thickness of an electron emission film 33 is approximately the same as the film thickness of the electron emission film 3. Further, an average particle (grain) diameter of a particle (grain) 15 contained in the electron emission film 3 is preferably not less than 1 nm and not more than 10 nm. Further, concentration of metal in the electron emission film 3 is preferably not less than 0.001 at % and not more than 30 atm %. Further, electrical resistivity of the carbon film part which is a main component in the electron emission film 3 is not less than $1\times10^{8}$ Ω·cm and not more than $1\times10^{14}$ Ω·cm.

Step F

Step F is a step for providing a dipole layer on the surface of the electron emission film 3.

The dipole layer can be formed, for example, by chemically modifying the surface of the electron emission film 3. More specifically, by terminating the surface of the electron emission film 3 by hydrogen, step F can be performed.

By this step, the emission of the electron can be made much easier.

The termination by hydrogen can be performed by heating the electron emission film 3 in the atmosphere containing hydrogen and hydrocarbon gas. As the hydrocarbon gas, an acyclic hydrocarbon can be preferably used. As the acyclic hydrocarbon, particularly, any of acetylene gas, ethylene gas, and methane gas can be preferably used. The termination by hydrogen may be performed at the end of step E, but performing the termination for the electron emission film 3 not subjected to step E may be one of the modes.

Further, a mode of selecting the heating temperature and the gas atmosphere and simultaneously performing steps E and F can be also adopted.

Next, an exemplary application applied to the electron emission device producible by the present invention will be described below. A plurality of electron emission devices producible by the present invention is disposed on the substrate, thereby, for example, an electron source and an image display device can be formed.

Figure 4:
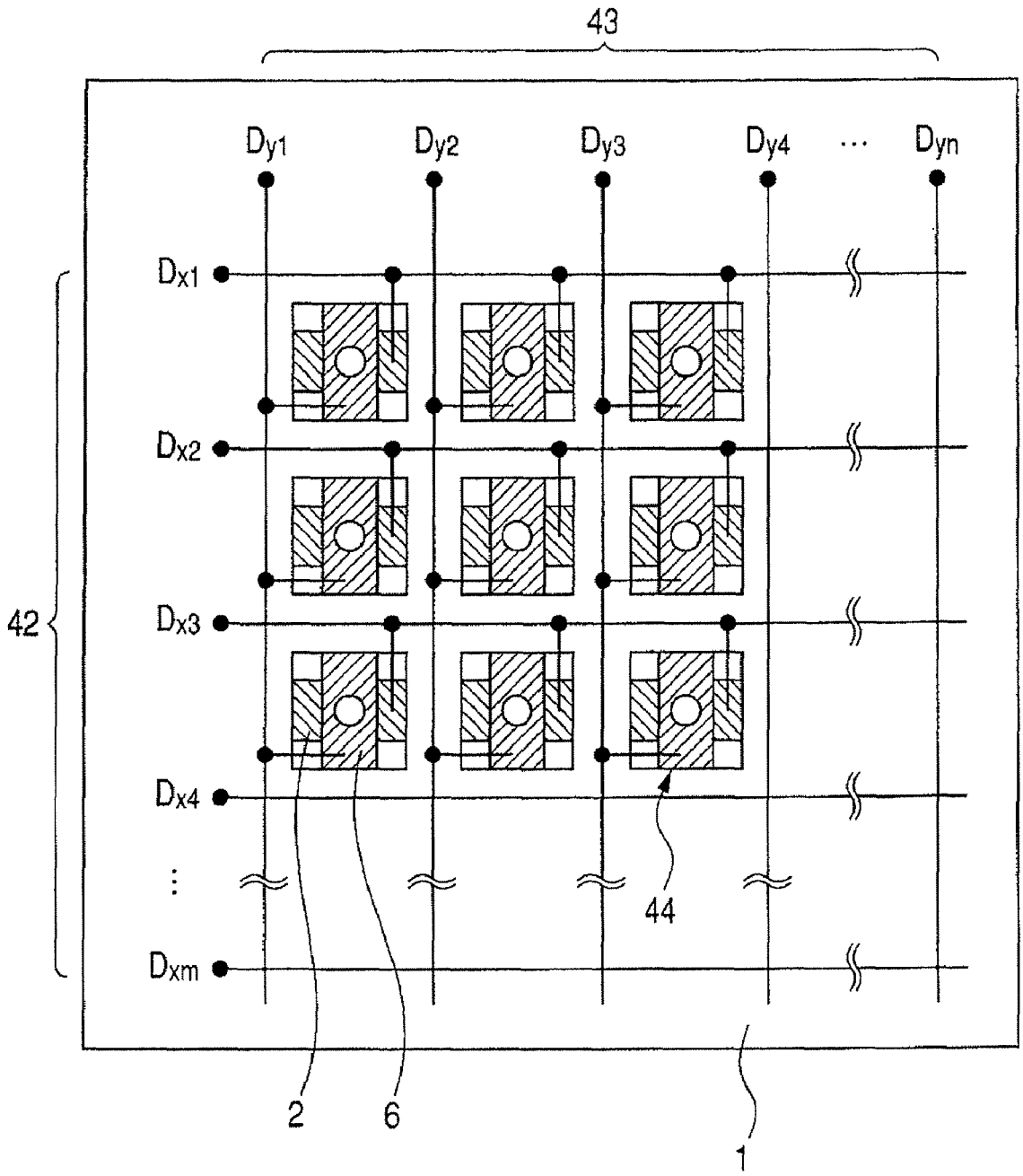
FIG. 4 is a block diagram illustrating an electron source of a simple matrix arrangement according to the present invention.

By using FIG. 4, the electron source obtained by disposing the plurality of electron emission devices will be described. In FIG. 4, reference numeral 1 denotes a substrate, reference numeral 42 an X direction wiring, reference numeral 43 a Y direction wiring, and reference numeral 44 an electron-emitting device produced by the producing method of the present invention. While FIG. 4 illustrates an example in which one aperture is formed for one electron-emitting device, the aperture may be provided in plurality.

The X direction wiring 42 includes the m number of Dx1, Dx2, . . . Dxm, and can be made of a conductive material such as metal formed by using the vacuum deposit, printing method, and sputtering method and the like. A material, film thickness, and width of the wiring are suitably designed. The Y direction wiring 43 includes the n number of Dy1, Dy2, . . . Dyn, and is formed similarly to the X direction wiring 42.

Between the m number of these X direction wirings and the n number of these Y direction wirings 43, unillustrated interlayer insulating layers are provided, and electrically separate both of these wirings. Here, m and n are both positive integers. The unillustrated interlayer insulating layers include oxide silicon and the like formed by using the vacuum vapor-deposit method, printing method, sputtering method, and the like.

The first electrode (cathode electrode) 2 included in an electron emission device 44 is electrically connected to one among from the m number of X direction wirings 42, and the third electrode (gate electrode) 6 is electrically connected to one among from the n number of Y direction wirings 43.

The materials included in the X direction wiring 42 and Y direction wiring 43 and the first electrode 2 and third electrode 6 may be the same in part or the whole of constituent elements or may be different, respectively. When the materials and the wiring materials included in the first electrode and the third electrode are the same, the X direction wiring 42 and the Y direction wiring 43 can be also referred to as the first electrode or the second electrode, respectively.

The X direction wiring 42 is connected to an unillustrated scan signal applying unit for applying a scanning signal in order to select a column of the electron-emitting device 44 lined up in the X direction. On the other hand, the Y direction wiring 43 is connected to an unillustrated modulation signal generating unit in order to modulate each column of the electron-emitting device 44 lined up in the Y direction according to the input signal. The driving voltage applied to each electron-emitting device is defined as a differential voltage between the scanning signal and the modulation signal applied to the device.

Figure 5:
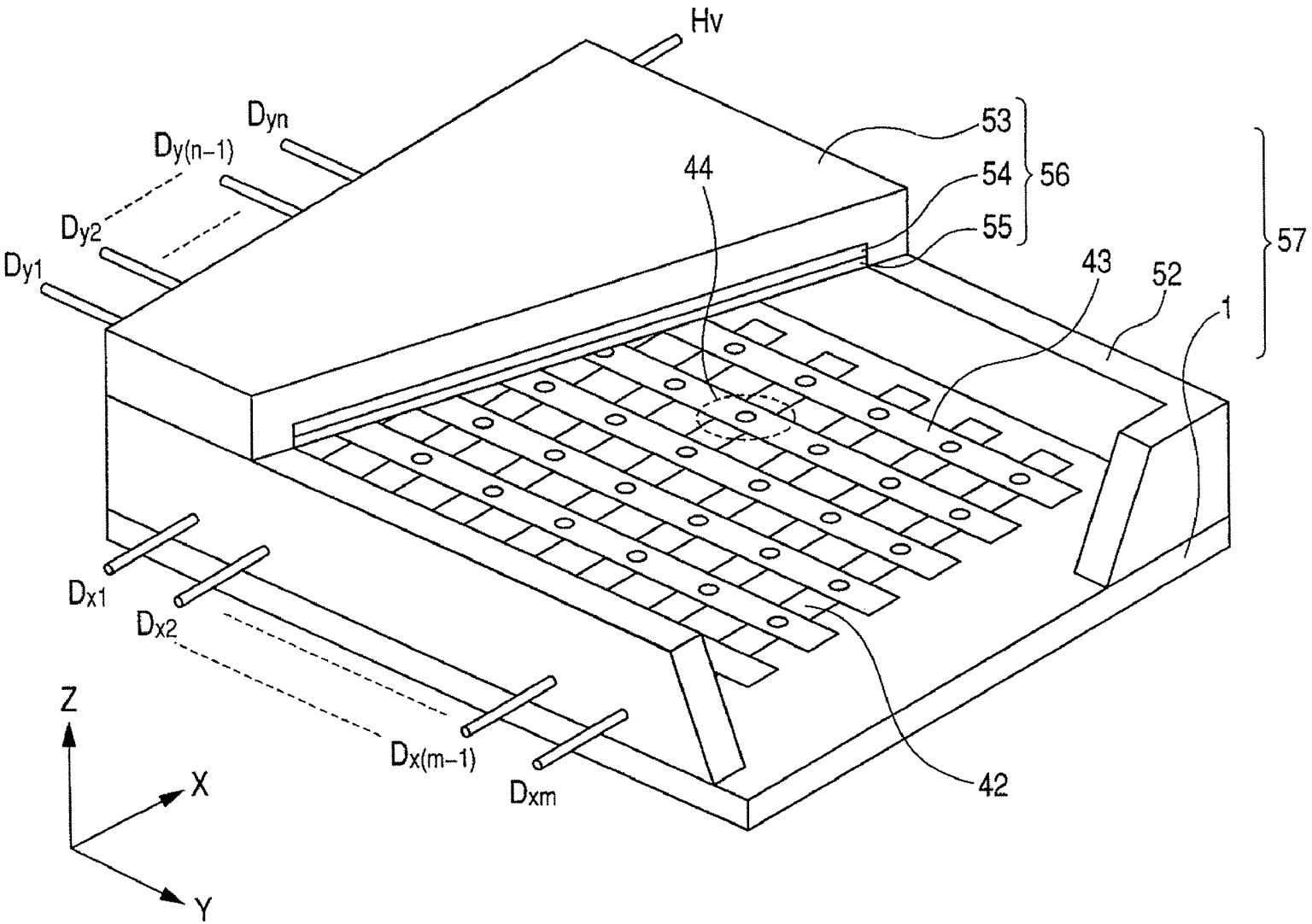
FIG. 5 is a schematic block diagram illustrating an image display device according to the present invention.

In the above described configuration, an individual electron-emitting device is selected, and can be independently driven. An image display device formed by using the electron source of such a matrix arrangement will be described by using FIG. 5. FIG. 5 is a schematic illustration showing one example of a display panel of the image display device.

In FIG. 5, a substrate (rear plate) 1 is disposed with a plurality of electron-emitting devices, and a substrate 53 is transparent similarly to a glass and the like. A face plate 53 includes the substrate 53, a light-emitting film 54 emitting a light by irradiation of electron beams, and a metal back 55 as the anode electrode. A support frame 52 is connected to the rear plate 1 and the face plate 56 by using a bonding agent such as frit glass. An envelope 57 includes the face plate 56, the rear plate 1, and the support frame 52. The envelope 57 (vacuum container) uses, for example, Indium as the bonding agent, and can be formed in a state in which the support frame 52 is sandwiched by the rear plate 1 and the face plate 56 in vacuum and heated by being pressurized in the direction facing one another ensuring the sealed holding of the interior thereof. Further, the above described heating temperature is preferably set to the temperature lower than the heating temperature at step C and the heating temperatures at steps E and F.

The envelope 57 disposes an unillustrated support medium referred to as a spacer between the face place 56 and the rear plate 1 enabling to have sufficient strength against atmospheric pressure.

Further, by using the image display device of the present invention and combining the device with a tuner, a display device (including a so-called Television Receiver) for various broadcasts by way of television broadcasts, data broadcasts, satellite broadcasts, and internet can be formed. Further, the display device can be also used as a display device for TV conference system and computer.

EXAMPLES

Examples of the present invention will be described below in detail.

Example 1

The electron-emitting device having the configuration illustrated in FIGS. 1A and 1B was fabricated according to the step illustrated in FIGS. 2A, 2B, 2C and 2D.

Step 1

Quartz was used for the substrate 1, and after cleansing it sufficiently, by the sputtering method, TiN was deposited on the substrate 1 with a thickness of 100 nm as the first layer 10.

Step 2

Photosensitive resin was deposited on the first layer 10, and was heated and dried, and was subjected to exposure and development, thereby forming the second layer 11. This photosensitive resin can use a type having a photosensitive base in resin and a type containing a photosensitizer in resin.

Step 3

Pt was deposited on the second layer 11 so as to have a thickness of 50 nm as the third layer 12 containing metal.

Step 4

Oxide silicon was deposited 1000 nm on the third layer 12 by a plasma CVD method as the fourth layer (layer including the insulating material) 13.

Step 5

TiN was deposited on the fourth layer 13 so as to have a thickness of 50 nm as the fifth layer 14 as shown in FIG. 2A.

Step 6

Next, a positive type photoresist was spin-coated on the fifth layer 14, and a photo mask pattern (circular) was exposed and developed, thereby forming a mask pattern (circular aperture). The aperture diameter W1 at this time was taken as 1.5 μm.

Step 7

Figure 2B:
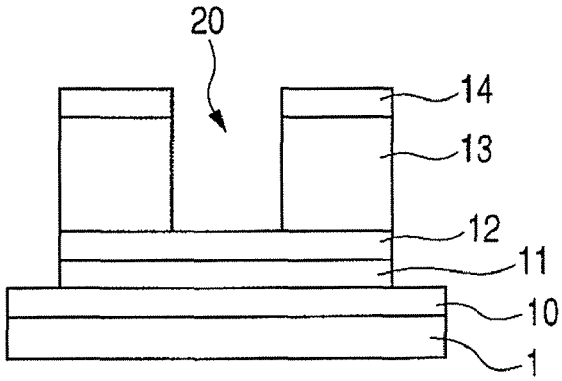

As shown in FIG. 2B, by a dry etching, the fifth layer 14 and the fourth layer 13 are partially removed, and the etching is stopped on the third layer 12, and the first aperture 20 was formed.

Step 8

The remained mask pattern (not illustrated) was removed by a stripper, and was cleansed by water.

Step 9

Figure 2C:
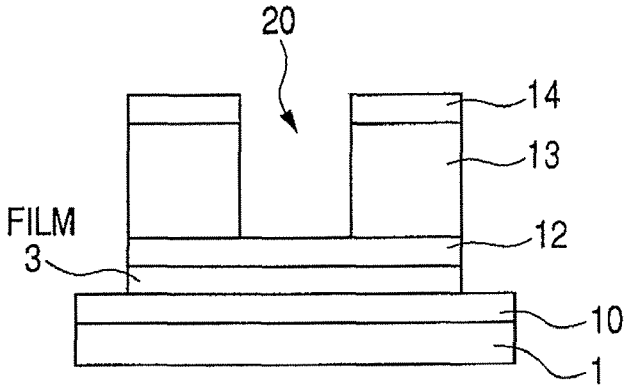

Next, 600° C. was maintained for one hour in vacuum of $1\times10^{-4}$ Pa, and Pt of the third layer 12 was diffused into the second layer 11, and after that, while vacuum was kept, natural cooling was performed, thereby forming the electron emission film 3 as shown in FIG. 2C.

Step 10

Figure 2D:
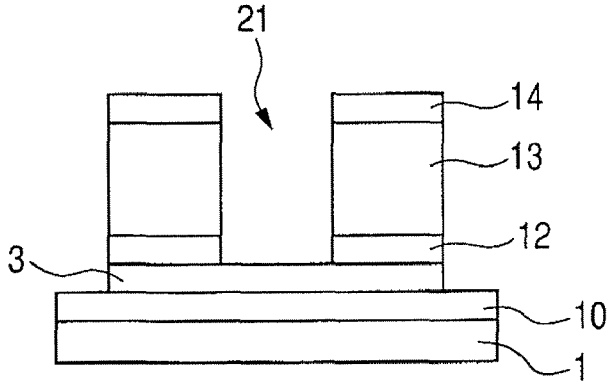

With the fifth layer 14 as a mask, the aperture 21 penetrating through the third layer 12 and reaching the electron emission film 3 (electron emission film 3 is exposed) was formed, thereby completing the electron-emitting device of the present example as shown in FIG. 2D.

An average content of Pt in the electron emission film 3 of the electron-emitting device fabricated in this manner was 3 atm %, and the film thickness of the electron emission film 3 was 30 nm, and adhesiveness between the electron emission film 3 and the first layer 10 as well as the third layer 12 was also secured.

The electron emission characteristic of this electron-emitting device is measured. As shown in FIG. 8, the electron-emitting device fabricated by the present example was driven with the anode electrode 7 disposed above the electron emitting device. At the driving time, a voltage Va was applied between the anode electrode 7 and the cathode electrode 2 (first layer 10), and a voltage Vb was applied between the cathode electrode 2 (first layer 10) and the gate electrode 6 (fifth layer 14), thereby measuring the electron emission characteristic.

The applied voltage was taken as the voltage Va =10 kV between the anode electrode 7 and the cathode electrode 2 (first layer 10) and the voltage Vb=20 V between the cathode electrode 2 (first layer 10) and the gate electrode 6 (fifth layer 14). The distance H between the electron emission film 3 and the anode electrode 8 was taken as 2 mm. Here, by using an electrode coated with phosphor as the anode electrode 8, the size of electron beam was observed. Comparing to the electron beam from the electron-emitting device not provided with the convergence electrode 4 but otherwise forming the same laminate structure, the size of the electron beam becomes small, and even when driven for a long period, no phenomenon occurred, in which the members of the electron-emitting device are peeled off from the substrate.

Example 2

The electron-emitting device having the configuration as illustrated in FIGS. 1A and 1B was fabricated according to the steps as illustrated in FIGS. 6A, 6B, 6C and 6D.

Step 1

Quartz was used for the substrate 1, and after cleansing it sufficiently, TiN was deposited on the substrate 1 with a thickness of 100 nm as the first layer 10.

Step 2

On the first layer 10, a diamond like carbon film was deposited, and was made into the second layer 11.

Step 3

On the second layer 11, Co was deposited so as to have a thickness of 50 nm as the third layer 12.

Step 4

On the third layer 12, SiO2 was deposited 1,000 nm as the fourth layer (insulating layer) 13.

Step 5

Figure 6A:
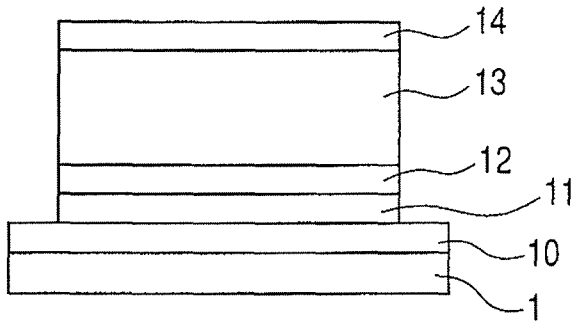
FIGS. 6A, 6B, 6C and 6D are schematic illustrations showing one example of the method of producing the electron-emitting device according to the present invention.

On the fourth layer 13, TiN was deposited so as to have a thickness of 50 nm as the fifth layer 14 as shown in FIG. 6A.

Step 6

Figure 6B:
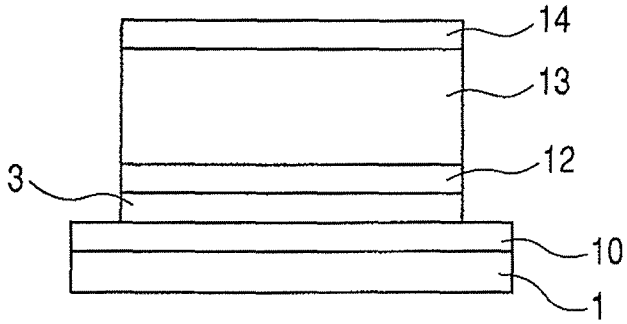

Next, 600° C. was maintained for one hour in vacuum of $1\times10^{-4}$ Pa, and Co contained in the third layer 12 was diffused into the second layer 11, thereby forming the electron emission film 3 as shown in FIG. 6B.

Step 7

Next, on the fifth layer 14, a positive type photoresistor was spin-coated, and a photo mask pattern (circular) was exposed and developed, thereby forming a mask pattern (circular aperture). The aperture diameter W1 at this time was taken as 1.5 μm.

Step 8

Figure 6C:
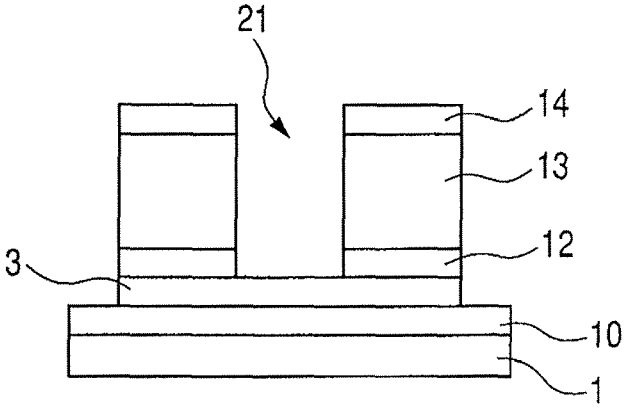

As shown FIG. 6C, by a dry etching, the first aperture 21 penetrating through the fifth layer 14, the fourth layer (insulating layer) 13, and the third layer 12 was formed. Etching was controlled so that the aperture 21 stops on the surface of the electron emission film 3.

Step 9

The remaining mask pattern (not illustrated) was removed by a stripper, and was cleansed by water.

Step 10

Next, 600° C. was maintained for one hour in vacuum of $1\times10^{-4}$ Pa, and Co in the electron emission film 3 was grained, thereby forming a Co particle (grain) 15.

Step 11

Figure 6D:
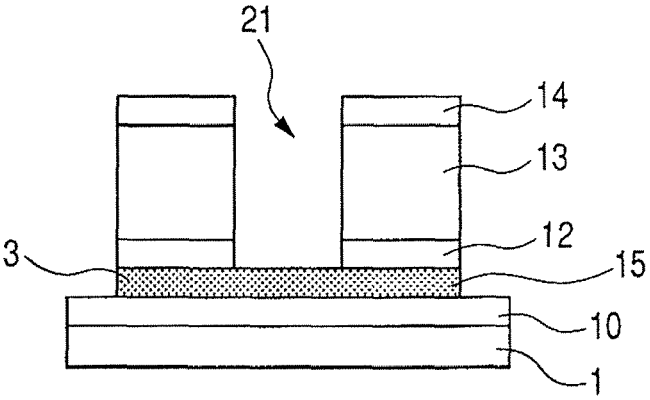

Next, in the atmosphere containing acetylene 0.1% and hydrogen 99.9%, the electron emission film 3 was subjected to heat treatment by 550° C. for five hours, thereby completing the electron-emitting device of the present example as shown in FIG. 6D.

In the electron-emission film 3 of the electron-emitting device fabricated in this manner, a Co particle (grain) 15 was discretely formed in great numbers. The Co concentration in the electron emission film 3 was 0.02 atm %, and the film thickness of the electron emission film 3 was 30 nm, and adhesiveness between the electron emission film 3 and the first layer 10 as well as the third layer 12 was also good.

Further, the electron emission characteristic of this electron-emitting device were measured. The electron emission characteristic of the electron-emitting device fabricated by the present example was measured similarly to Example b 1.

The applied voltages were Va=10 kV and Vb=20 V, the distance H between the electron emission film 3 and the anode electrode 8 was taken as 2 mm. Here, the electrode coated with phosphor was used as the anode electrode 8, and the size of electron beam was observed. Comparing to the electron beam from the electron-emitting device not provided with the convergence electrode 4 but otherwise forming the same laminate structure, the fact that the size of the electron beam becomes small was confirmed. Further, the electron emission characteristic, as compared to Example 1, was such that the electron emission amount per unit area was large, and the driving voltage was also low.

Example 3

Figure 7A:
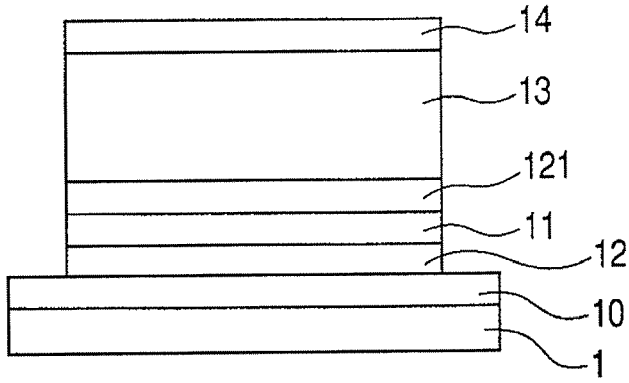
FIGS. 7A, 7B and 7C are schematic illustrations showing one example of the method of producing the electron-emitting device according to the present invention.
Figure 7B:
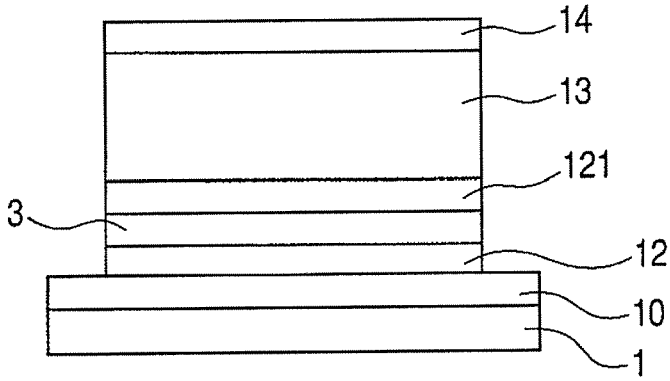
Figure 7C:
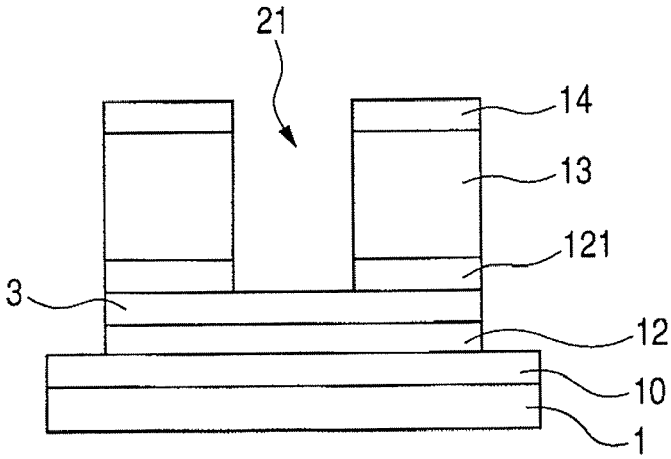

The electron-emitting device was fabricated according to the steps as illustrated in FIGS. 7A, 7B and 7C.

Step 1

Quartz was used for the substrate 1, and after cleansing it sufficiently, by the sputtering method, TiN was deposited on the substrate 1 with a thickness of 100 nm as the first layer 10.

Step 2

On the first layer 10, Co was deposited so as to have a thickness of 50 nm as the third layer 12 containing metal.

Step 3

On the third layer 12, a diamond like carbon film was deposited as the second layer 11, and was taken as a main ingredient layer 32.

Step 4

On the second layer 11, TiN was deposited so as to have a thickness of 50 nm as a conductive layer 121.

Step 5

On the conductive layer 121, SiO2 was deposited 1000 nm as the fourth layer (insulating layer) 13.

Step 6

On the fourth layer 13, TiN was deposited so as to have a thickness of 50 nm as the fifth layer 14.

Step 7

Next, 600° C. was maintained for one hour in vacuum of $1\times10^{-4}$ Pa, and Co in the third layer 12 was diffused into the second layer 11, thereby forming the electron emission film 3. In this heating step, metal is substantially not diffused from the conductive layer 121 to the second layer 11.

Step 8

Next, a positive type photoresist was spin-coated on the fifth layer 14, and a photo mask pattern (circular) was exposed and developed, thereby forming a mask pattern (circular aperture). The aperture diameter W1 at this time was taken as 1.5 μm.

Step 9

By a dry etching, the aperture 21 penetrating through the fifth layer 36, the fourth layer 13, and the conductive layer 121 was formed. Etching was controlled so that the aperture 21 stops on the surface of the electron emission film 3.

Step 10

The remaining mask pattern (not illustrated) was removed by a stripper, and was cleansed by water, thereby completing the electron-emitting device of the present example.

Thus, in the present example, the third layer 12 which diffuses metal between the second layer 11 and the first layer 10 was provided. The average concentration of Co in the electron emission film 3 was 3 atm %, and the film thickness of the electron emission film 3 was 30 nm, and since the third layer 12 was disposed between the first conductive layer 10 and the electron emission film 3, the adhesiveness between the electron emission film 3 and the first layer 10 became larger than Examples 1 and 2.

Further, when the electron emission characteristic of this electron-emitting device was measured similarly to Example 1, the same good electron emission characteristic as Example 1 could be obtained.

Example 4

By using the electron-emitting device fabricated by Example 2 described above, the image display device illustrated in FIG. 5 was fabricated.

The electron-emitting device fabricated by the same method as Example 2 was disposed in a matrix pattern of 100 pieces×100 pieces. As shown in FIG. 5, the X direction wirings (Dx1 to Dxm) were connected to the cathode electrodes 2, and the Y direction wiring (Dy1 to Dyn) sides were connected to the gate electrodes 7. Each electron-emitting device was disposed at a pitch of 300 μm horizontal and 300 μm vertical. Above each electron-emitting device, phosphor was disposed.

The image display device fabricated by the present example, allowed the matrix driving to be performed, and was able to obtain a highly precise with few variations in luminance and good display image for a long period of time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-034032, filed Feb. 10, 2006, which is hereby incorporated by reference herein in its entirety.

What is claimed is:

1. A method of producing an FE type electron-emitting device provided with a gate hole aperture at an electron emission region, which includes a cathode, an electron emission film comprising a carbon layer including metal, which is disposed on the cathode and provided with the electron emission region therein, and an electron beam focusing electrode disposed on a predetermined region on the electron emission film and a gate electrode, comprising the steps of:

A) fabricating a laminate structure which comprises at least an electroconductive layer forming the cathode, a carbon layer in contact with the electroconductive layer, a metal layer or a metal-containing layer in contact with the carbon layer, an insulating layer on the metal layer or metal-containing layer and a conductive layer forming the gate electrode on the insulating layer; and subsequently B) heating at least the formed carbon layer and the formed metal or metal-containing layer to diffuse metal contained in the metal layer or metal-containing layer into the carbon layer, C) removing part of the metal layer or metal-containing layer, part of the insulating layer and part of the gate electrode-conductive layer after the processing of said step (B) to form the gate hole aperture by exposing part of the carbon layer which constitutes the electron emission region, wherein part of the metal layer or metal-containing layer remained after the removal processing step (C) which surrounds the gate hole aperture constitutes the electron beam focusing electrode.

2. A method according to claim 1, wherein in said step (B), the diffused metal is grained in the electron emission film.

3. A method according to claim 1, wherein the metal layer or the metal-containing layer consists essentially of metal or metals selected from a group of Fe, Co, Ni, Pd and Pt or alloy of metal or metals selected from the group.

4. A method of fabricating an image forming device which includes the electron emitting device produced according to claim 1 and a light-emitting screen irradiated by electrons emitted from the electron-emitting device.

5. A method of producing an FE type electron-emitting device provided with a gate hole aperture at an electron emission region, which includes a cathode, an electron emission film disposed on the cathode and provided with an electron emission region therein, an electron beam focusing electrode disposed on a predetermined region of the electron emission film and a gate electrode, comprising the steps of:

A) fabricating a laminate structure which comprises at least an electroconductive layer forming the cathode, a precursor layer of the electron emission film in contact with the electroconductive layer, a metal layer or metal-containing layer in contact with the precursor layer, an insulating layer on the metal layer or metal-containing layer and a conductive layer forming the gate electrode on the insulating layer; and subsequently B) heating at least the formed precursor layer and the formed metal layer or metal-containing layer to diffuse metal contained in the metal layer or metal-containing layer into the precursor layer, and C) removing part of the metal layer or metal-containing layer, part of the insulating layer and part of the gate electrode-conductive layer after the processing of said step (B) to form the gate hole aperture by exposing at least part of the precursor layer, wherein part of the metal layer or metal-containing layer remained after the removal processing step (C) which surrounds the gate hole aperture constitutes the electron beam focusing electrode.

6. A method according to claim 5, wherein in said step (B), the diffused metal is grained in the electron emission film.

7. A method according to claim 5, wherein the metal layer or metal-containing layer consists essentially of metal or metals selected from a group of Fe, Co, Pd and Pt or alloy of metal or metal selected from the group.

8. A method of fabricating an image forming device including the electron-emitting device produced according to claim 5 and a light-emitting screen irradiated by electrons emitted from the electron emitting device.

* * * * *